US007129915B2

(12) United States Patent
Park et al.

(10) Patent No.: US 7,129,915 B2
(45) Date of Patent: Oct. 31, 2006

(54) METHOD AND APPARATUS FOR DRIVING ELECTRO-LUMINESCENCE DISPLAY DEVICE

(75) Inventors: Kyung Vin Park, Kyoungsangbuk-do (KR); Se Don Kim, Kyoungsangbuk-do (KR); Yoon Heung Tak, Kyoungsangbuk-do (KR)

(73) Assignee: LG Electronics Inc., Seoul (KR)

( * ) Notice: Subject to any disclaimer, the term of this patent is extended or adjusted under 35 U.S.C. 154(b) by 225 days.

(21) Appl. No.: 10/394,152

(22) Filed: Mar. 24, 2003

(65) Prior Publication Data

US 2003/0179165 A1 Sep. 25, 2003

(30) Foreign Application Priority Data

Mar. 25, 2002 (KR) ..... 10-2002-0016127

(51) Int. Cl.
*G09G 3/30* (2006.01)

(52) U.S. Cl. ..... 345/76; 315/169.3

(58) Field of Classification Search ..... 345/74.1–83, 345/690–693; 315/169.3
See application file for complete search history.

(56) References Cited

U.S. PATENT DOCUMENTS 5,847,516 A * 12/1998 Kishita et al. ..... 315/169.3
6,339,415 B1 * 1/2002 Ishizuka ..... 345/76

FOREIGN PATENT DOCUMENTS

JP 2001013923 1/2001
JP 2001350431 A * 12/2001

* cited by examiner

*Primary Examiner*—Alexander Eisen
(74) *Attorney, Agent, or Firm*—Birch, Stewart, Kolasch and Birch, LLP

(57) ABSTRACT

A method for driving an electro-luminescence display device is provided. The method includes selecting a scan line by applying a scan signal to any one of a plurality of scan lines, wherein the scan signal falls down to a voltage higher than a ground voltage; and applying a constant voltage to a plurality of data lines crossing the scan lines in synchronization with the scan signal.

13 Claims, 10 Drawing Sheets

METHOD AND APPARATUS FOR DRIVING ELECTRO-LUMINESCENCE DISPLAY DEVICE

BACKGROUND OF THE INVENTION

1. Field of the Invention

The present invention relates to an electro-luminescence display device, and more particularly to a method and apparatus for driving an electro-luminescence display device that is adaptive for increasing brightness uniformity.

2. Description of the Related Art

Recently, there has been developed various flat display devices, which can be reduced in weight and bulk where a cathode ray tube CRT has a disadvantage. Such flat display panel includes a liquid crystal display, a field emission display, a plasma display panel, and electro-luminescence (hereinafter, EL) display device.

The structure and fabricating process of the PDP is relatively simple, thus the PDP is most advantageous to be made large-sized, but the light emission efficiency and brightness thereof is low and its power dissipation is high. It is difficult to make the LCD large-sizes because of using a semiconductor process, but since it is mainly used as a display device of a notebook computer, the demand for it increases, however there is a disadvantage that the LCD can hardly be made into a large-sized one and that power dissipation is high due to a backlight unit. Further, light loss by optical devices such as a polarizing filter, a prism sheet and diffusion plate is high and a viewing angle is narrow in the LCD. As compared with this, the EL display device is generally classified into an inorganic EL and an organic EL, and there is an advantage that its response speed is fast, its light-emission efficiency and brightness are high, and it has wide viewing angle. The organic EL display device can display a picture in a high brightness of several ten thousands [cd/m$^2$] with a voltage of about 10[V].

In the organic EL display device, as shown in FIG. 1, there is formed an anode (+) 2 of transparent conductive material on a glass substrate 1, and there are deposited a hole injection layer 3, a light-emission layer 4 of organic material, an electron injection layer 5 and a cathode (−) 6 of metal on top of it. If an electric field is applied between the anode (+) 2 and the cathode (−) 6, holes in the hole injection layer 3 and electrons in the electron injection layer 5 respectively progress toward the light-emission layer 4 to be combined in the light-emission layer. Then, a fluorescent material in the light-emission layer 4 gets excited and transferred to generate a visible light. At this moment, the brightness is not proportional to a voltage between the anode (+) 2 and the cathode (−) 6 but is proportional to a current. Accordingly, an apparatus for driving the organic EL display device is generally driven by a constant current source.

Referring to FIG. 2, the apparatus for driving an organic display device of the related art includes a constant current source 21 applying current to data lines DL1 to DLm, and switching devices 22 and 23 applying a scan high voltage Vhigh and a ground voltage GND to each of scan lines SL1 to SLn.

The data lines DL1 to DLm act as the cathodes in FIG. 1, and the scan lines SL1 to SLn act as the anodes in FIG. 1. There are formed (m×n) number of pixel cells 20 at intersections of m number of data lines DL1 to DLm and n number of scan lines SL1 to SLn. The constant current source 21 is realized as two or more switching devices and a current mirror including the current source. The constant current source 21 synchronized with scan pulses applied to the scan lines SL1 to SLn in accordance with input data applies the constant current to the data lines DL1 to DLm. The switching devices 22 and 23 are realized as transistor devices such as MOS-FET. The switching devices 22 and 23 connected to the scan lines SL1 to SLn sequentially apply negative scan voltages to the scan lines SL1 to SLn to select the scan line where data are displayed. To this end, the switching devices 22 connected to the ground voltage source GND are turned on in response to a control signal T1 to apply the ground voltage GND to the selected scan line, and the switching devices 23 connected to the scan high voltage source Vhigh is turned on in response to a control signal T2 to apply the scan high voltage Vhigh to an unselected scan line.

FIG. 3 represents scan pulses applied to the scan lines SL1 to SLn, and data pulses applied to the data lines applied to the data lines DL1 to DLm.

Referring to FIG. 3, scan pulses SCAN are sequentially applied as negative voltages, i.e., forward voltage, to the scan lines SL1 to SLn, and data pulses DATA synchronized with the scan pluses SCAN are applied as positive current to the data lines DL1 to DLm. At this moment, light is emitted only at the pixel cells DATA to which the positive current is applied in accordance with the data among the pixel cells DATA connected to the scan lines SL1 to SLn to which the negative voltage is applied.

On the other hand, charges of reverse direction are charged in both ends of the pixel cell 20 connected to the unselected scan line. In such a state, if the scan line is selected when the negative voltage is applied to the unselected scan line, the pixel cells 20 charged with the reverse charges takes a considerable delay time Δt for being charged to a desired positive data current level as in a data RDATA applied to an actual EL panel of FIG. 4. This is because the input current applied to the pixel cells 20 charged with the reverse charges is wasted by the reverse charge.

The data delay of the organic EL display device can be explained in conjunction with Formula 1. When the equivalent capacitance of the pixel cell 20 is C, the voltage charged in the pixel cell 20 is V, the amount of charges charged in the pixel cell 20 is Q, and the current inputted to the pixel cell 20 is I, the charge amount charged in the pixel 20 is determined as in the following Formula 1.

$$Q=C\times V=I\times t \qquad \text{[FORMULA 1]}$$

If the current is uniform in accordance with time, the time t taken to charge the pixel cell 20 to a desired voltage is (C×V)/I. For example, if C is 2.4[nF] and I is 200[ ], the time taken to charge the pixel cell 20 to 10[V] is (2.4[nF]×10[V])/200[μA]=120[μs]. Such a charging time is a considerably long time as compared with the light-emission time of a scan line in the organic EL display device.

Such a delay time deteriorates an effective response speed of the pixel cells 20. In order to compensate the deterioration of the response speed, the input current should be increased, but it causes another problem of increasing power dissipation to occur because the driving voltage of each pixel 20 should be increased.

Further, in the driving apparatus of the EL display device of the relate art, the brightness between the data lines DL1 to DLm is difficult to make uniform because the data lines DL1 to DLm is driven by the constant current source 21. In order to make the brightness between the data lines DL1 to DLm uniform, the current applied to each data line DL1 to DLm must be the same. To this end, it is required to minimize the current deviation scope of a plurality of data driving integrated circuits IC each including the constant current source 21. For example, the current deviation scope of each data driving IC must be limited to within 50±0.5[μA] for making the brightness of each data lines DL1 to DLm uniform to be about 20[nit]. In realizing an actual circuit, designing and fabricating the data driving IC with the current deviation of within 1% not only increases the IC unit price, but also it is difficult to drive each data driving IC in within the desired current deviation even in case that the driving IC's are applied to the actual EL panel.

SUMMARY OF THE INVENTION

Accordingly, it is an object of the present invention to provide a method and apparatus for driving an electro-luminescence display device that is adaptive for increasing brightness uniformity.

In order to achieve these and other objects of the invention, a method for driving an electro-luminescence display device according to an aspect of the present invention includes selecting a scan line by applying a scan signal to any one of a plurality of scan lines, wherein the scan signal falls down to a voltage higher than a ground voltage; and applying a constant voltage to a plurality of data lines crossing the scan lines in synchronization with the scan signal.

The method further includes inputting an order to vary a brightness level; and selecting a voltage level of the constant voltage in response to the brightness level variation order.

The method further includes allowing a supply time of the constant voltage applied to the data lines to vary in accordance with a gray level value of an input data.

In the method, the electro-luminescence display device is a passive matrix type.

A driving apparatus for an electro-luminescence display device according to another aspect of the present invention includes a scan driver selecting a scan line by applying a scan signal to any one of a plurality of scan lines, wherein the scan signal falls down to a voltage higher than a ground voltage; and a data driver applying a constant voltage to a plurality of data lines crossing the scan lines in synchronization with the scan signal.

Herein, a voltage applied to the data driver is the same as a voltage applied to the data lines.

Herein, a voltage difference between a voltage applied to the data driver and a voltage applied to the data lines is 0.5[V] or less.

The driving apparatus further includes a selector selecting a voltage level of the constant voltage in response to an order for varying a brightness level.

Herein, the data driver varies a supply time of the constant voltage applied to the data lines in accordance with a gray level value of an input data.

The scan driver includes a first switching device for switching a current path between the scan lines and a ground voltage source that generates the ground voltage; a second switching device for switching a current path between the scan lines and a voltage source that generates a specific scan high voltage; and a third switching device for switching a current path between the scan lines and the first switching device.

The scan driver further includes a comparator comparing a voltage in the scan line with a specific reference voltage; and a switching device controlling the voltage in the scan line by control of the comparator.

Herein, the reference voltage is set to be higher than the ground voltage.

Herein, the reference voltage is set to be higher than the ground voltage by 0.5[V] or more.

Herein, the electro-luminescence display device is a passive matrix type.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

With reference to FIGS. 5 to 12, embodiments of the present invention will be explained as follows.

Figure 1:
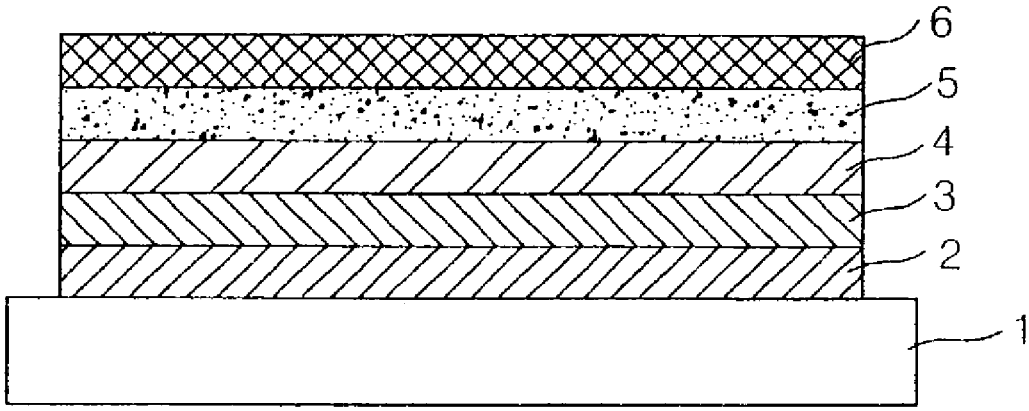
FIG. 1 RELATED ART
FIG. 1 is a sectional view briefly representing an organic electro-luminescence display device of the related art.
Figure 2:
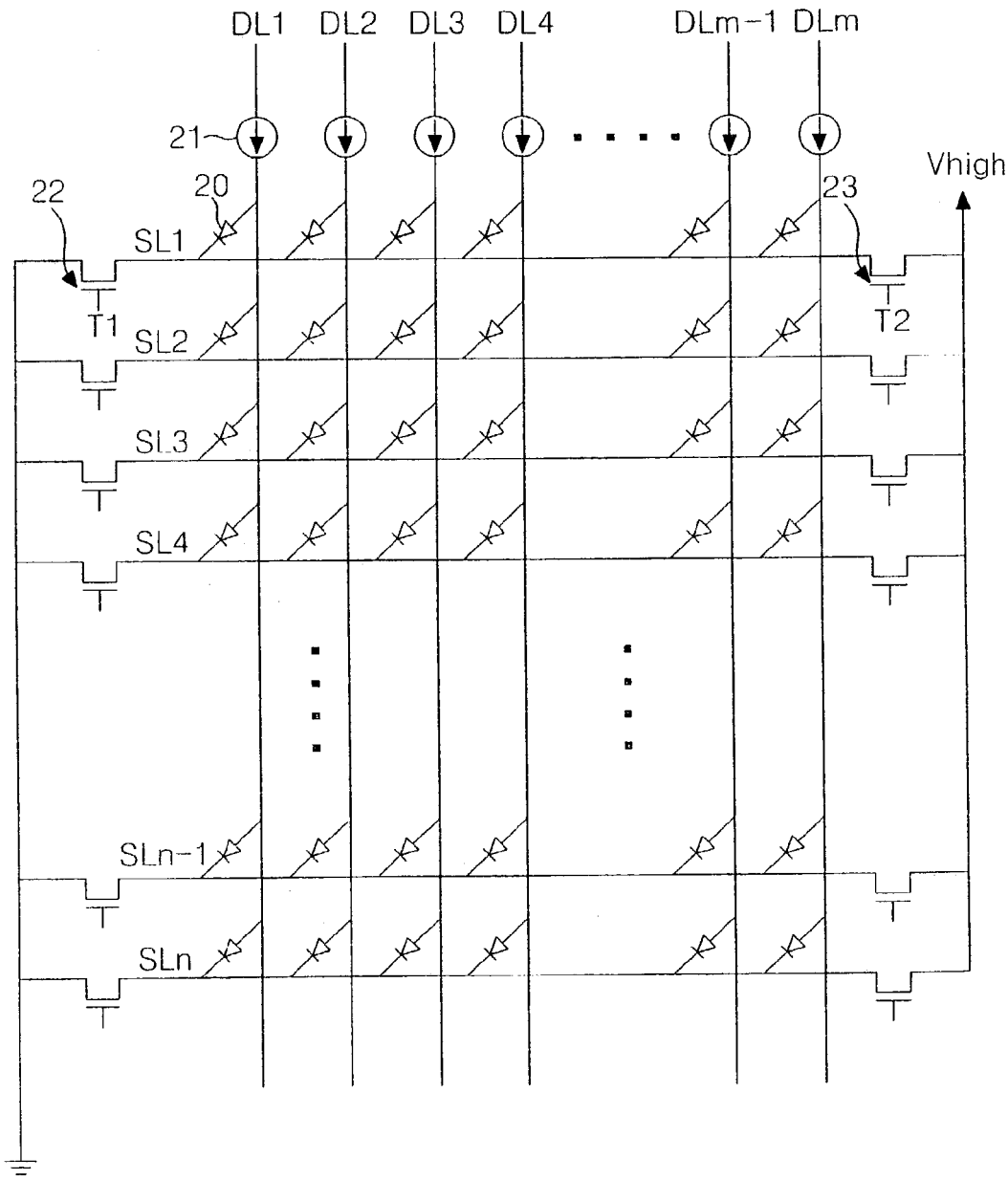
FIG. 2 RELATED ART
FIG. 2 is a plan view representing a driving apparatus and an electrode arrangement of an organic electro luminescence display device of the related art.
Figure 3:
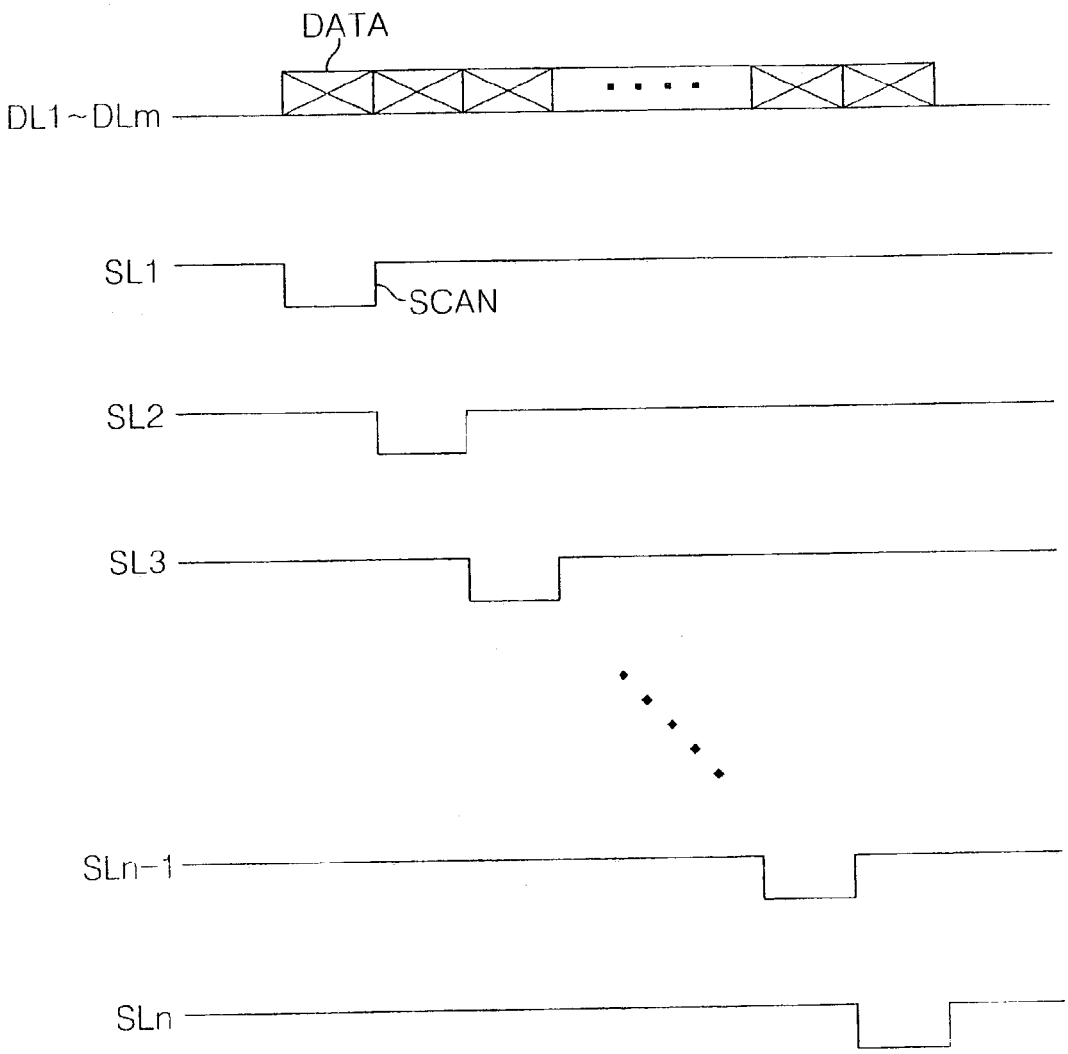
FIG. 3 RELATED ART
FIG. 3 is a waveform representing driver signals outputted from the driving apparatus shown in FIG. 2.
Figure 4:
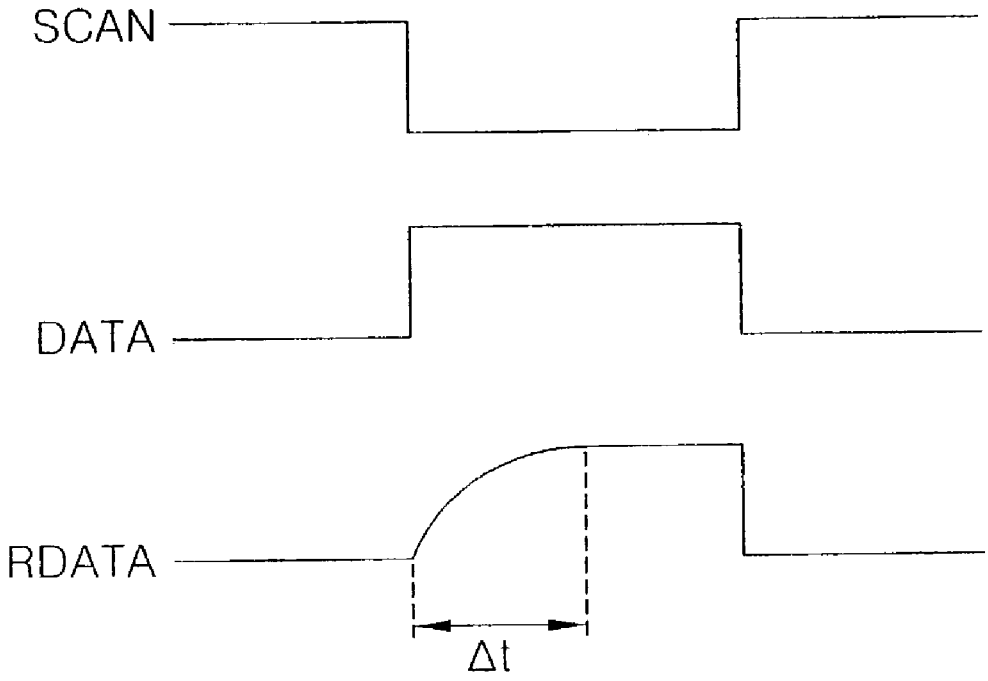
FIG. 4 RELATED ART
FIG. 4 is a waveform representing the delay of data shown in FIG. 3.
Figure 5:
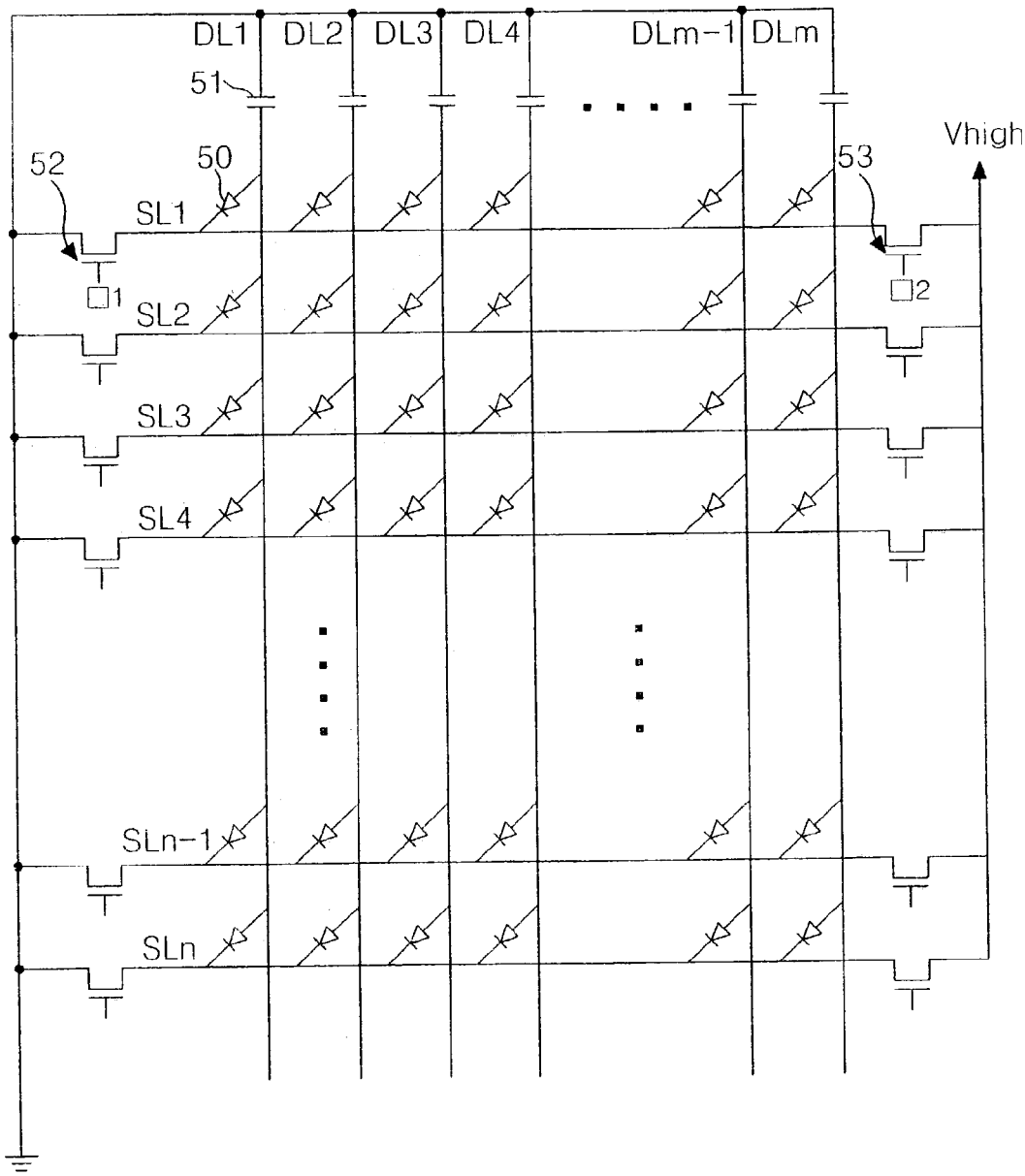
FIG. 5 is a plan view representing a driving apparatus and an electrode arrangement of an organic electro luminescence display device according to the first embodiment of the present invention.

Referring to FIG. 5, a driving apparatus of an EL panel according to the first embodiment of the present invention includes a passive matrix type EL panel, a constant voltage source 51 for applying voltages to data lines DL1 to DLm, and switching devices 52 and 53 for applying a scan high voltage Vhigh and a ground voltage GND to each scan line SL1 to SLn.

The EL panel is formed in a passive matrix type. There are formed (m×n) number of pixel cells 50 at intersections of m number of data lines DL1 to DLm and n number of scan lines SL1 to SLn in the EL panel.

The constant voltage source 51 applies positive constant voltages to the data lines DL1 to DLm when scan pulses are synchronized and input data are applied. The switching devices 52 and 53 connected to the scan lines SL1 to SLn sequentially applies negative scan voltages to the scan lines SL1 to SLn to select the scan line where data are displayed. To this end, first switching devices 52 connected to the ground voltage source GND are turned on in response to a control signal Φ1 to apply a ground voltage GND to the selected scan lines, and second switching devices 53 connected to scan high voltage source Vhigh are turned on in response to a control signal Φ2 to apply a scan high voltage Vhigh to the unselected scan lines. Each of the first and second switching devices 52 and 53 is integrated as an IC.

Figure 6:
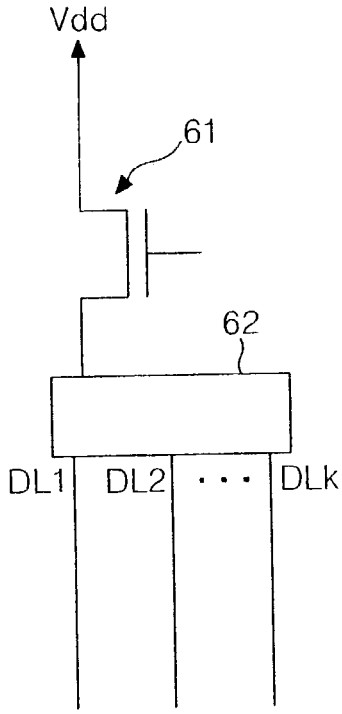
FIG. 6 is a circuit diagram representing in detail an embodiment of the circuit configuration of a constant voltage source and a switching device for switching the constant voltage source.
Figure 7:
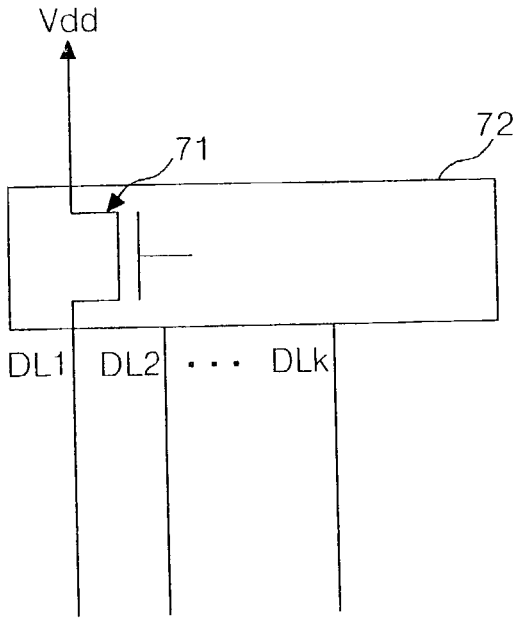
FIG. 7 is a circuit diagram representing in detail another embodiment of the circuit configuration of a constant voltage source and a switching device for switching the constant voltage source.

Each constant voltage source 51 can be included in a data driving IC as a separate constant voltage source, but it is desirable for the constant voltage source 51 to be applied as a common power source Vdd, which is supplied to each data driving IC 62 from the outside as shown in FIG. 6. Each data driving IC 62 is connected to k (but, k is a positive integer smaller than m) number of data lines. A switching device 61 shown in FIG. 6 is connected between the constant voltage source 51 of the outside and the input terminal of the data-driving IC to be turned on/off in accordance with whether data are applied or not. The switching device 61 is turned on when the data are inputted, so the constant voltage from the constant voltage source 51 is applied to the corresponding data line. In this case, the external constant voltage applied to the data driving IC 62 is the same voltage as applied to the data lines DL1 to DLm. The switching device 61 can be integrated within a data driving IC 72 as shown in FIG. 7. In this case, the voltage difference between the voltage applied to the data driving IC 72 and the voltage applied to the data lines DL1 to DLm becomes about 0.5 V or less by a parasitic resistance and a parasitic capacitance between the drain terminal and the source terminal of the switching device 71.

As can be seen in FIGS. 6 and 7, data driving IC's 62 and 72 include only one switching device for switching the constant voltage as compared with the current mirror containing a plurality of switching devices and a current source, thus the number of devices is reduced and it becomes easy to design and fabricate the data driving IC.

Figure 8:
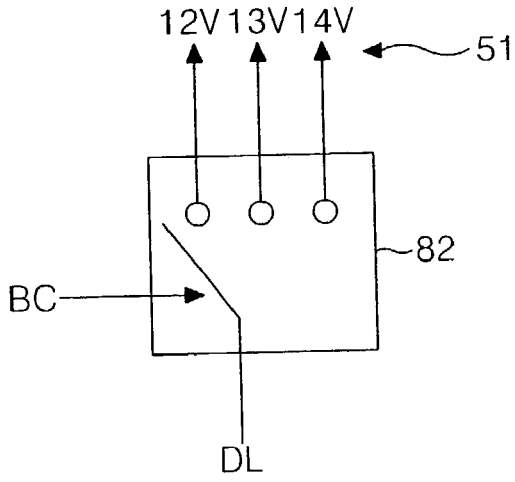
FIG. 8 is a circuit diagram representing a constant voltage sources corresponding to a brightness variation level, which can be controlled, and a switching device for selecting the constant voltage source.

On the other hand, the constant voltage source 51 can be realized as a plurality of voltage sources, e.g., 12[V], 13[V] and 14[V], corresponding to a controllable brightness step as in FIG. 8, so that the brightness of the display picture can be displayed in accordance with the brightness that is controlled by a user. A brightness control circuit (not shown) is mode-converted when the user controls the brightness mode, and a brightness control signal BC is generated upon the mode-conversion. The brightness control signal controls a switching device 82 connected between the constant voltage source 51 and the data line DL to select a constant voltage level as in FIG. 8.

The amount of current applied to each data line DL1 to DLm is determined in accordance with the constant voltage level applied from each constant voltage source 51, thus a data delay caused by a current delay of the prior art is minimized. Further, the EL driving apparatus can reduce the voltage deviation of each constant voltage source 51 more easily than the current deviation of each constant current source is reduced by means of circuit, thus the error range for the voltage deviation of each constant voltage 51 can also be easily controlled in 0.1[V] or less. Accordingly, the method and apparatus for driving the EL according to the embodiment of the present invention can minimize the brightness deviation of each data line DL1 to DLm as well as reduce the data delay.

Figure 9:
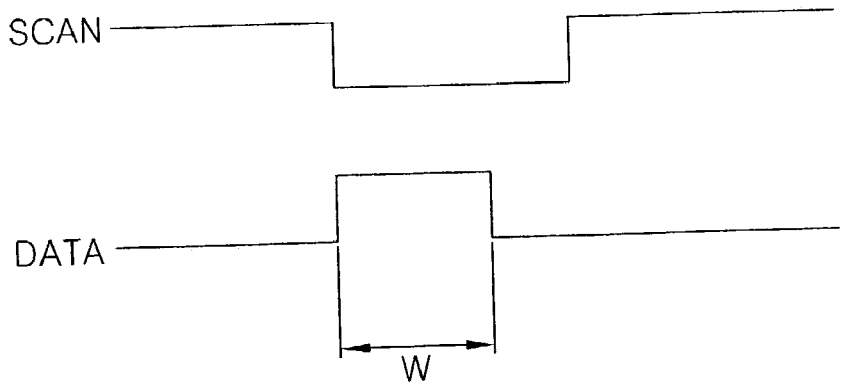
FIG. 9 is a waveform diagram representing a scan pulse and a data pulse outputted from a driving apparatus shown in FIG. 5.

FIG. 9 represents a scan pulse applied to scan lines SL1 to SLn and a data pulse applied to data lines DL1 to DLm.

Referring to FIG. 9, scan pulses SCAN are sequentially applied as negative voltages, i.e., forward voltages, to the scan lines SL1 to SLn, and data pulses DATA synchronized with the scan pluses SCAN are applied as positive voltages to the data lines DL1 to DLm. The width W of the data pulse DATA increases and decreases in accordance with the gray level value of an input data. In other words, the method and apparatus for driving the EL according to the present invention controls the light-emission time of the pixel cell 50 by a pulse width modulation method PWM to express the gray level. To this end, a timing controller (not shown) controls the on-time of switching devices 61 and 71 shown in FIG. 6 and 7 in accordance with the gray level value of the input data.

Figure 10:
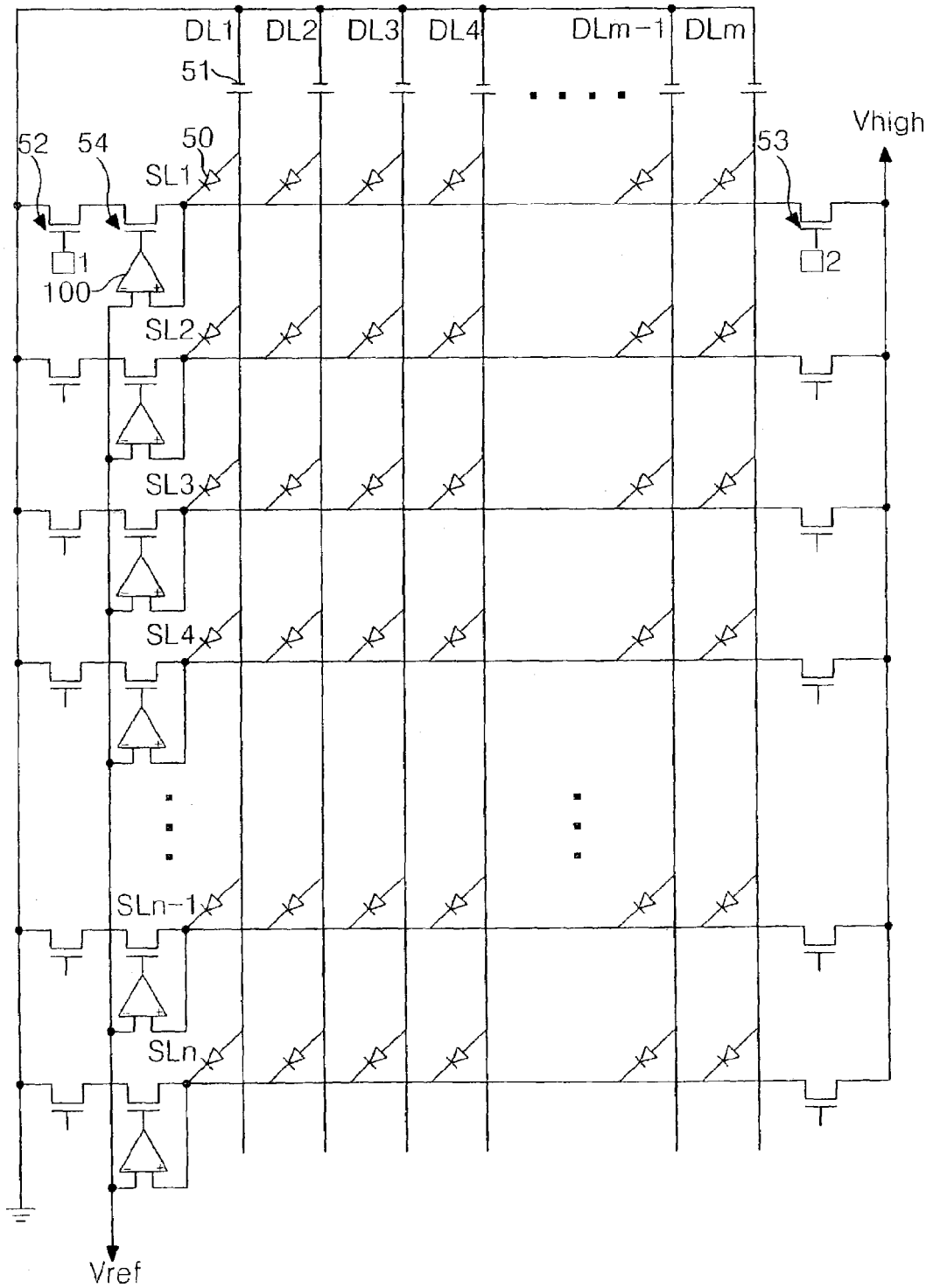
FIG. 10 is a plan view representing a driving apparatus and an electrode arrangement of an organic EL display device according to the second embodiment of the present invention.

FIG. 10 represents a driving apparatus of an EL panel according to the second embodiment of the present invention.

Referring to FIG. 10, the driving apparatus of the EL panel according to the second embodiment of the present invention includes an EL panel of passive matrix type, a constant voltage source 51 applying a voltage to data lines DL1 to DLm, first and second switching devices 52 and 53 applying scan high voltages Vhigh and ground voltages GND to each of scan lines SL1 to SLn, comparators 100 comparing a specific reference voltage Vref with a voltage on the scan lines SL1 to SLn, and third switching devices 54 switching current paths between the scan lines SL1 to SLn and the ground voltage source GND under control of the comparators 100.

The constant voltage source 51 applies positive constant voltages to the data lines DL1 to DLm when an input data synchronized with a scan pulse is applied. The first and second switch devices 52 and 53 connected to the scan lines SL1 to SLn sequentially apply the negative scan voltages to the scan lines SL1 to SLn to select the scan line where the data is displayed. To this end, the first switching devices 52 connected to the ground voltage source GND are turned on in response to control signals Φ1 to discharge the scan lines, and the second switching devices 53 connected to a scan high voltage source Vhigh are turned on in response to control signals Φ2 to apply scan high voltages Vhigh to the unselected scan line.

The non-inversion input terminals of the comparators 100 are connected to the scan lines SL1 to SLn, and the inversion input terminals of the comparators 100 are connected to a reference voltage source Vref. The output terminals of the comparators 100 are connected to the control terminals, i.e., the gate terminals, of the third switching devices 54. Each comparator 100 compares the reference voltage Vref with a voltage in the scan line SL1 to SLn and generates an output signal of low logic when the voltage in the scan line SL1 to SLn is lower than the reference voltage Vref. And then, the generated output signal is applied to the control terminal of the third switching device 54. If the voltage in the scan line SL1 to SLn is equal to or higher than the reference voltage Vref, each comparator 100 generates an output signal of high logic to apply the generated output signal to the control terminal of the third switching device 54. The fourth switching devices 57 cut off a current path between the drain terminal and the source terminal when the voltage in the scan line SL1 to SLn is lower than the reference voltage Vref in response to the output signal of low logic of the comparator. If the voltage in the scan line SL1 to SLn is equal to or higher than the reference voltage Vref, the fourth switching devices 57 allows the current path to conduct between the drain terminal and the source terminal in response to the output signal of high logic of the comparator.

As a result, the comparators 100 and the third switching devices 54 drop the voltage in the scan lines SL1 to SLn not to the ground voltage GND but to the reference voltage Vref in the same manner. In other words, the comparators 100 and the third switches 54 act to make the voltage in the scan lines SL1 to SLn drop not to the ground voltage but to a designated reference voltage Vref when scan pulses SCAN are applied to the scan lines SL1 to SLn. This is because the voltage in the scan lines SL1 to SLn rises higher than the ground voltage GND and the deviation of the rising voltage can be different in each scan line SL1 to SLn by causes such as the current deviation of each scan driving IC and the deviation of the current applied to the scan driving IC through the data line DL1 to DLm and the pixel cell 50 when the voltage in the scan line SL1 to SLn drops. To this end, the reference voltage Vref is set to be the maximum voltage rising value of the scan line SL1 to SLn when the scan pulse is applied in consideration of the allowable current of the scan driving IC. The reference voltage Vref is set to be 0.5[V] or more, preferably about 2[V], assuming that ground voltage GND is 0[V].

Figure 11:
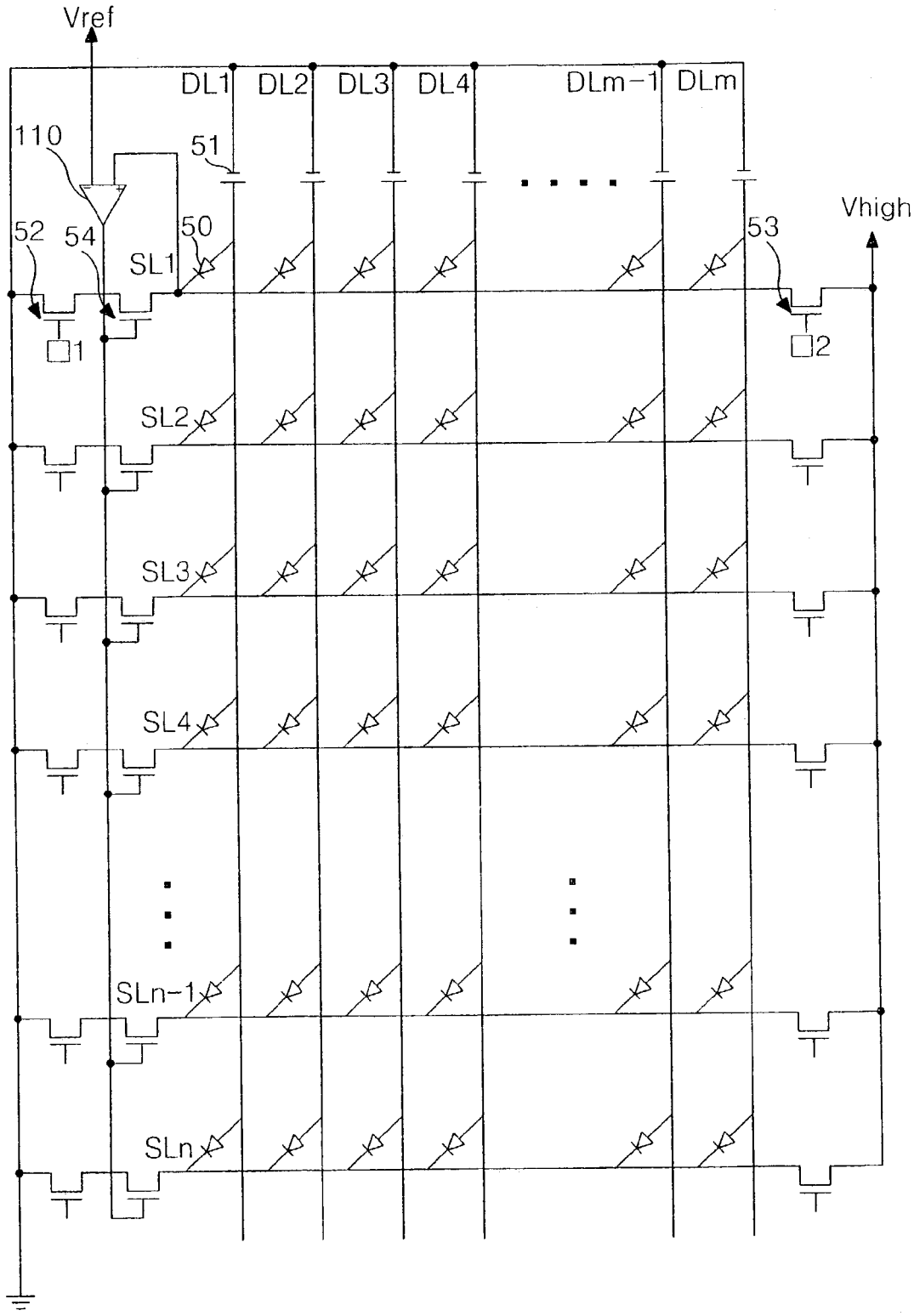
FIG. 11 is a plan view representing a driving apparatus and an electrode arrangement of an organic EL display device according to the third embodiment of the present invention.
Figure 12:
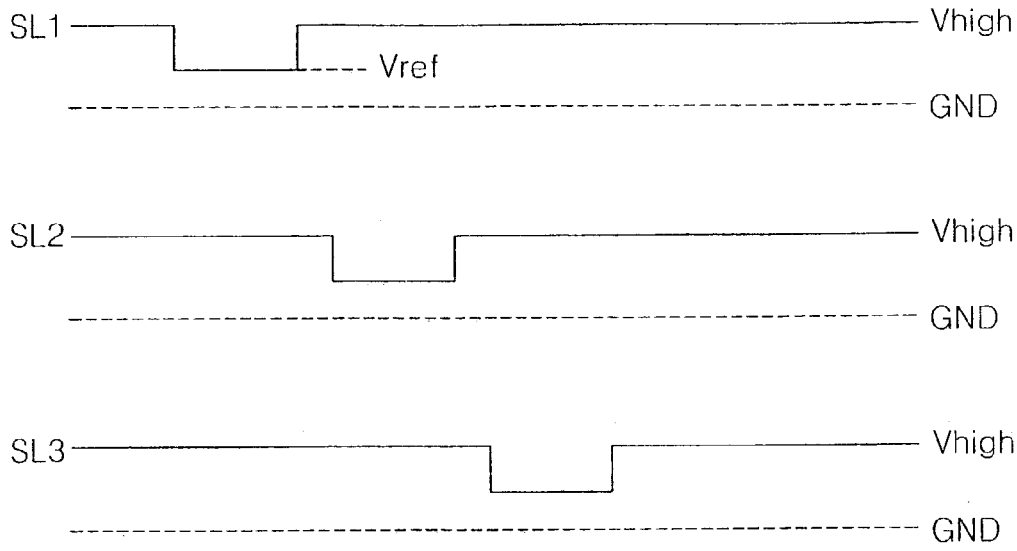
FIG. 12 is a waveform diagram representing a scan voltage controlled by a comparator and a third switching device shown in FIGS. 10 and 11.

The comparators 100 can be replaced with a common comparator 110 as shown in FIG. 11. The common comparator 110 substantially has the same function as the comparators 100 shown in FIG. 10.

As described above, the method and apparatus for driving the EL according to the present invention drives the data lines DL1 to DLm by the constant voltage source 51 to be able to make the brightness uniform. The method and apparatus for driving the EL according to the present invention does not need to increase the current to enable the power dissipation to be reduced as compared with the method and apparatus for driving the EL according to the related art where the current level is increased for increasing the brightness uniformity. In addition, the constant voltage source with less devices, as compared with the constant voltage source of the related art including many switching devices and current sources, is used to make the circuit configuration of the data driving IC simple and the unit price of the data driving IC reduced. Further, the method and apparatus for driving the EL according to the present invention drives the data lines DL1 to DLm by the constant voltage source so as to enable the response speed delay to be reduced, wherein the response speed delay is caused by the current delay that is known as a disadvantage of the driving method of the EL display device of the related art.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method for driving an electro-luminescence display device, comprising:

applying a scan signal to any one of a plurality of scan lines;

comparing a voltage of the scan signal in the scan lines with a reference voltage;

decreasing the voltage of the scan signal to a voltage higher than a ground voltage when the scan line is selected; and applying a constant voltage to a plurality of data lines crossing the scan lines in synchronization with the scan signal.

2. The method according to claim 1, further comprising:

inputting an order to vary a brightness level; and selecting a voltage level of the constant voltage in response to the brightness level variation order.

3. The method according to claim 1, further comprising: allowing a supply time of the constant voltage applied to the data lines to vary in accordance with a gray level value of an input data.

4. The method according to claim 1, wherein the electro-luminescence display device is a passive matrix type.

5. A driving apparatus for an electro-luminescence display device, comprising:

a scan driver selecting a scan line by applying a scan signal to any one of a plurality of scan lines, wherein the scan signal decreases to a substantially fixed voltage higher than a ground voltage when any one of the plurality of scan lines is selected, the scan driver further including:

a comparator comparing a voltage in the scan line with a specific reference voltage; and a switching device controlling the voltage in the scan line by control of the comparator; and a data driver applying a constant voltage to a plurality of data lines crossing the scan lines in synchronization with the scan signal.

6. The driving apparatus according to claim 5, wherein a voltage applied to the data driver is the same as a voltage applied to the data lines.

7. The driving apparatus according to claim 5, wherein a voltage difference between a voltage applied to the data driver and a voltage applied to the data lines is 0.5 volt or less.

8. The driving apparatus according to claim 5, further comprising: a selector selecting a voltage level of the constant voltage in response to an order for varying a brightness level.

9. The driving apparatus according to claim 5, wherein the data driver varies a supply time of the constant voltage applied to the data lines in accordance with a gray level value of an input data.

10. The driving apparatus according to claim 5, wherein the scan driver includes:

a first switching device for switching a current path between the scan lines and a ground voltage source that generates the ground voltage;

a second switching device for switching a current path between the scan lines and a voltage source that generates a specific scan high voltage; and a third switching device for switching a current path between the scan lines and the first switching device.

11. The driving apparatus according to claim 5, wherein the reference voltage is set to be higher than the ground voltage.

12. The driving apparatus according to claim 11, wherein the reference voltage is set to be higher than the ground voltage by 0.5 volt or more.

13. The driving apparatus according to claim 5, wherein the electro-luminescence display device is a passive matrix type.

* * * * *